US005918439A

United States Patent [19]

Metzer et al.

[11] Patent Number: 5,918,439

[45] Date of Patent: Jul. 6, 1999

[54] ROOF SHINGLE REPLACEMENT TOOL AND METHOD

[76] Inventors: John A. Metzer, 519 St. Lawrence Way, Furlong, Pa. 18925; James R. Kingham, 22955 Split Oak Pl., California, Md. 20619

[21] Appl. No.: 09/005,961

[22] Filed: Jan. 12, 1998

[51] Int. Cl.[6] ..... E04D 15/00

[52] U.S. Cl. ..... 52/748.1; 52/749.12; 52/DIG. 1; 33/649

[58] Field of Search ..... 52/749.12, 749.11, 52/DIG. 1, 748.1; 33/649, 648, 647, 646, 416, 417

[56] References Cited

U.S. PATENT DOCUMENTS

| | | | |
|---|---|---|---|
| 54,584 | 5/1866 | Newbank | 33/649 |
| 1,380,485 | 6/1921 | Langeberg | 33/649 |
| 4,183,144 | 1/1980 | Barnett, III . | |
| 4,285,134 | 8/1981 | Schmanski . | |
| 4,785,606 | 11/1988 | Burton . | |
| 4,860,518 | 8/1989 | Kingham . | |
| 5,018,279 | 5/1991 | Williams . | |
| 5,081,815 | 1/1992 | Carnell . | |
| 5,197,257 | 3/1993 | Nietling . | |
| 5,205,103 | 4/1993 | Burton . | |
| 5,526,577 | 6/1996 | Nix . | |

*Primary Examiner*—Carl D. Friedman
*Assistant Examiner*—Dennis L. Dorsey
*Attorney, Agent, or Firm*—Panitch Schwarze Jacobs & Nadel, P.C.

[57] ABSTRACT

A roof shingle placement tool is provided. The roof shingle placement tool includes a support member adapted to be disposed generally horizontally on a roof to be shingled. An indexing member is connected to the support member. The indexing member includes a plurality of equally spaced stops. The indexing member is adapted to be indexed upwardly along the roof with succeeding stops engaging a fixed reference point on the roof such that a uniform exposure distance is provided by the support member for succeeding courses of shingles.

28 Claims, 5 Drawing Sheets

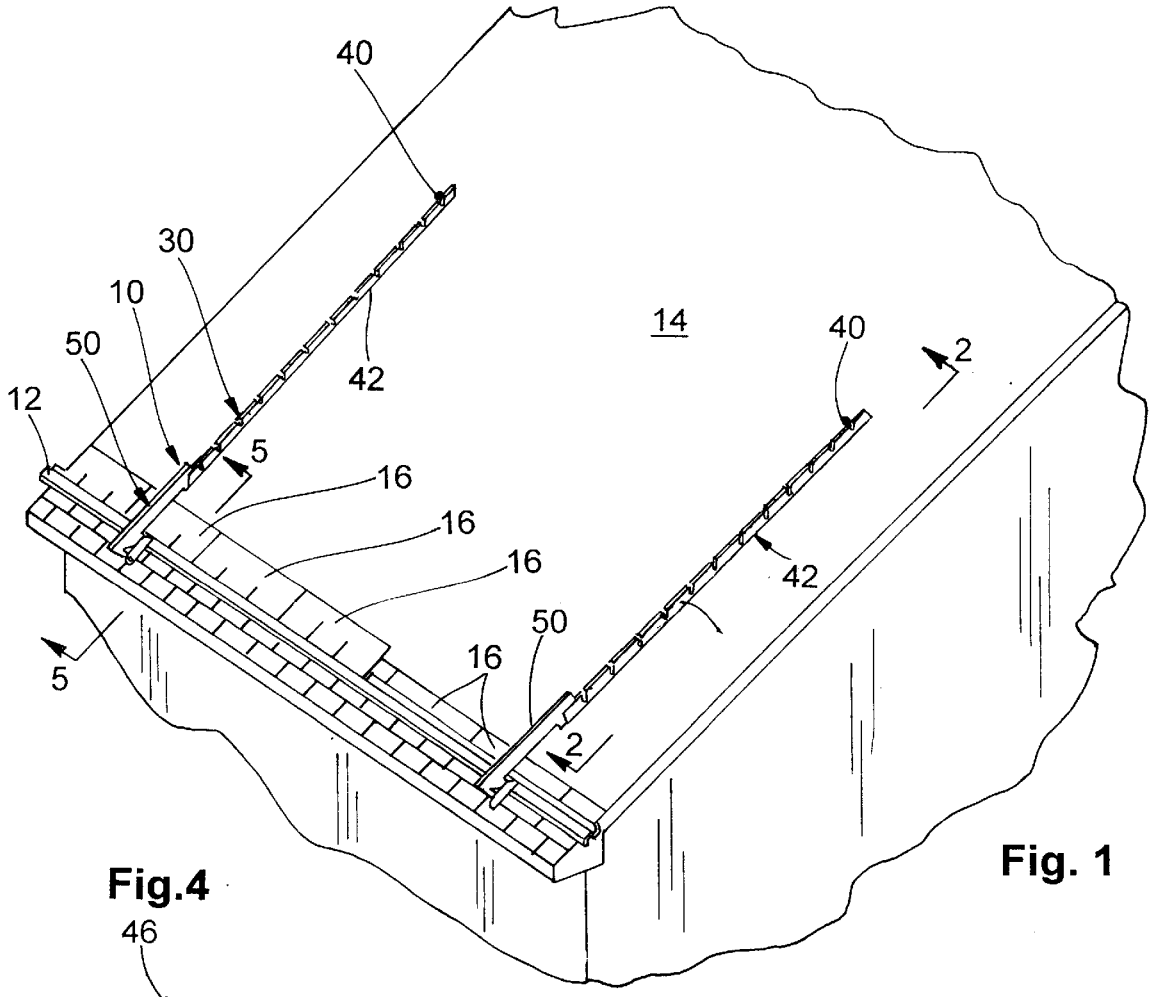
Fig. 1
Fig.4
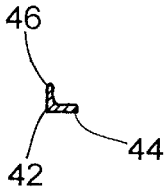
Fig. 3
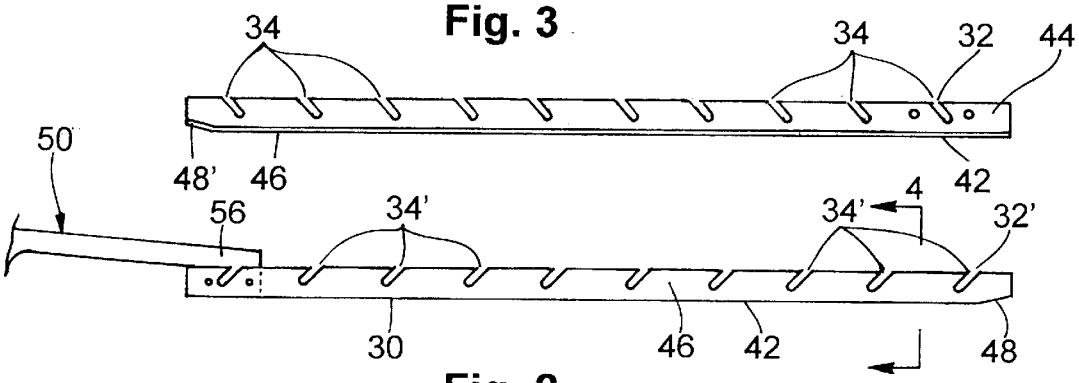
Fig. 2

Fig. 12
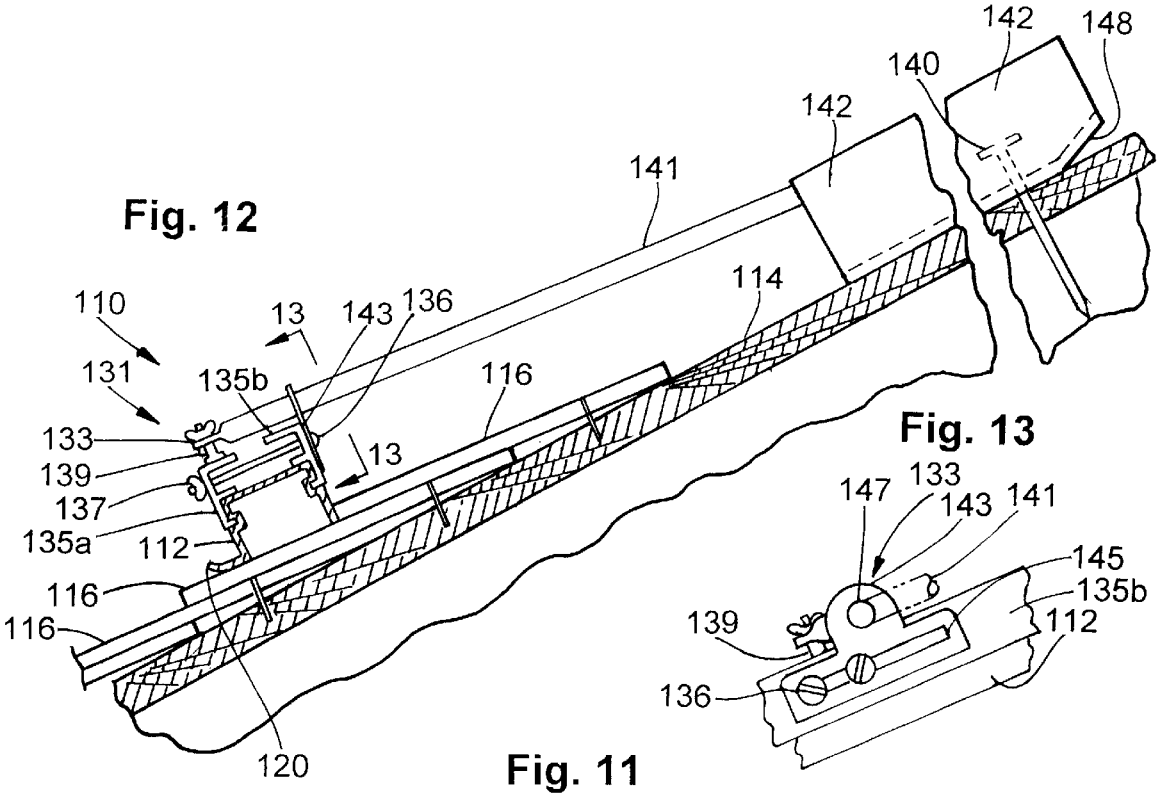
Fig. 13
Fig. 11
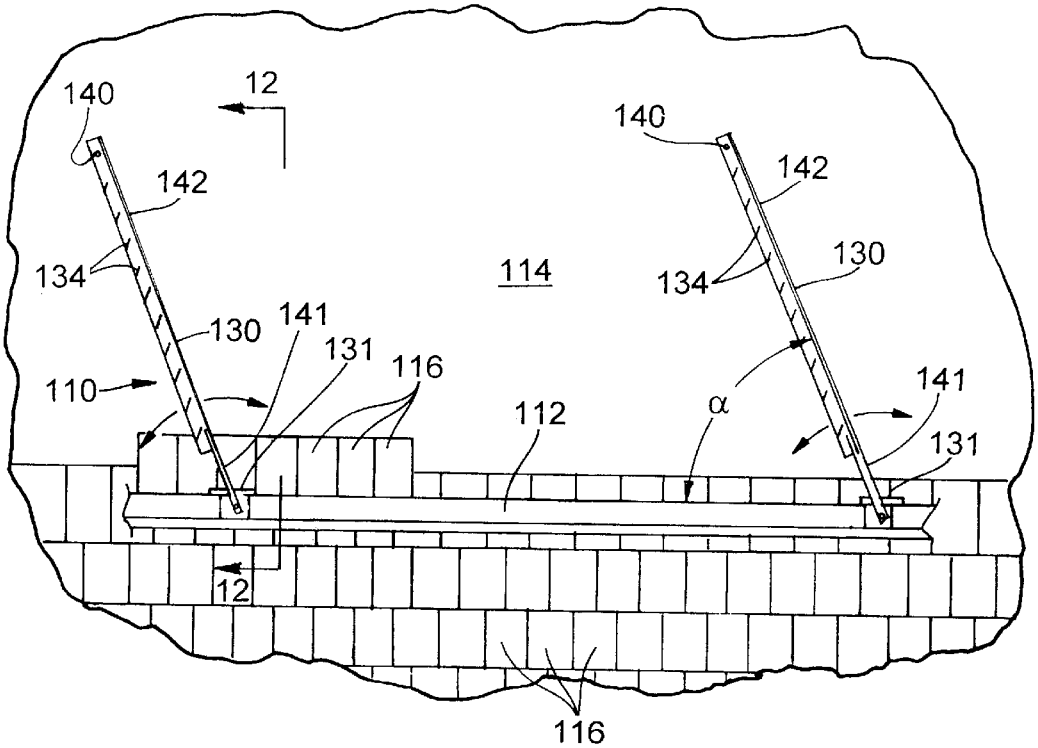

ROOF SHINGLE REPLACEMENT TOOL AND METHOD

BACKGROUND OF THE INVENTION

The present invention is directed to a roof shingle placement tool, and more particularly, to a tool for aligning and supporting shingles on the surface of a roof to allow for rapid and consistent installation.

Manual fixtures for laying shingles on the surface of a roof are generally known. Such fixtures generally include a support member which supports at least a portion of a course of shingles for installation, with the support member being movable in order to lay each succeeding course of shingles on the roof. One known system utilizes a pair of fixed rails and a movable support member. The fixed rails are temporarily attached to the roof, and the support member is indexed upwardly along the rails to provide a uniform exposure. However, a problem with this prior known fixture was that the rails prevented the installation of a complete course of shingles under the rail attachments, and shingles had to be filled in after the fixture was removed. Additionally, thin shingles could slip beneath the movable shingle support member if there was an irregularity in the roof surface.

Another known roof shingle placement apparatus, which was proposed by one of the co-inventors of the present invention and patented in U.S. Pat. No. 4,860,518, provides a guide or abutment surface for the bottom edges of thin pliable shingles allowing the shingles to be aligned in a row or course while ensuring that the shingles do not slip below the abutment surface at irregularities in the roof surface. However, this system also required fixed rails to be installed on the roof using standoffs to elevate the rails from the roof surface. The support member was then indexed upwardly along the rails to install the succeeding courses of shingles. While this provided some advantages over the prior known systems, it still did not allow the installation of shingles in the area of the rail supports, or required that the shingles be installed over the rail support base, with the base being slid out from under the installed shingles after the shingle installation was complete, leaving the anchoring nails in the roof.

Additionally, in laying shingles on a surface having an obstacle, such as a chimney or dormer, the prior known devices required that the fixed rails be located and attached to the roof one side of the obstacle, and then relocated and reattached to the roof on the other side of the obstacle, such that the support member could be used to lay identical courses of shingles on each side of the obstacle. This required additional set-up time for aligning and setting the fixed rails on the roof surface.

Another known apparatus provides a mechanized carriage which runs along a guide track to install shingles. The guide track is indexed upwardly relative to the roof to install succeeding courses of shingles. In another known device, a mechanized shingle carrying device is indexed upwardly relative to the guide track to install each succeeding courses of shingles.

It would be desirable to provide a fixture and method for placing shingles on the surface of a roof or vertical wall which could be easily transported to the work area rapidly assembled and installed and be easily indexed upwardly along the surface to apply succeeding courses of shingles with a minimum of structure being attached to the surface which could interfere with the placement of shingles.

BRIEF SUMMARY OF THE INVENTION

Briefly stated, the present invention provides a roof shingle placement tool. The roof shingle placement tool includes a support member adapted to be disposed generally horizontally on a roof to be shingled. An indexing member is connected to the support member. The indexing member includes a plurality of equally spaced stops. The indexing member is adapted to be indexed upwardly along the roof with succeeding stops engaging a fixed reference point on the roof such that a uniform exposure distance is provided by the support member for succeeding courses of shingles.

In another aspect, the present invention provides a method of locating shingles on a roof with a desired exposure between courses of shingles. The method comprises the steps of: (a) providing a support member and an indexing member connected to the support member, the indexing member including a plurality of equally spaced stops; (b) attaching a fixed member to the roof which is engageable by the indexing member; (c) setting a course of shingles on the support member; (d) fastening the shingles in position on the roof; and (e) indexing the support member upwardly along the roof by disengaging a first stop on the indexing member from the fixed member, moving the indexing member upwardly along the roof, and engaging a next stop on the indexing member on the fixed member.

In another aspect, the present invention provides a method of locating shingles on a roof with a desired exposure between each course of shingles. The method comprises the steps of: (a) providing an indexing member having a plurality of equally spaced stops and a support assembly having at least one stop; (b) installing a row of fixed members in the roof using the stops of the indexing member as a guide; (c) removing the indexing member; (d) placing the support assembly on the roof with the stop engaging a selected fixed member in the row of fixed members; (e) installing at least a portion of a course of shingles using the support assembly; and (f) indexing the support assembly upwardly along the roof by disengaging the stop on the support assembly from the selected fixed member, moving the support assembly upwardly along the roof, and engaging the stop on the support assembly on a next fixed member in the row of fixed members.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings:

FIG. 1 is a perspective view of the roof shingle placement tool in accordance with the present invention shown in use laying a course of shingles on a surface of a roof;

FIG. 2 is a side elevational view of an indexing member of the roof shingle placement tool shown in FIG. 1 taken along lines 2—2 in FIG. 1;

FIG. 3 is a top plan view of the indexing member shown in FIG. 2;

FIG. 4 is a cross-sectional view of the indexing member shown in FIG. 2 taken along lines 4—4 in FIG. 2;

FIG. 11 is a plan view of a roof with a second embodiment of a roof shingle placement tool in accordance with the present invention;

FIG. 12 is a cross-sectional view taken along lines 12—12 in FIG. 11;

FIG. 13 is an elevational view taken along lines 13—13 in FIG. 12;

DETAILED DESCRIPTION OF THE INVENTION

Figure 6:
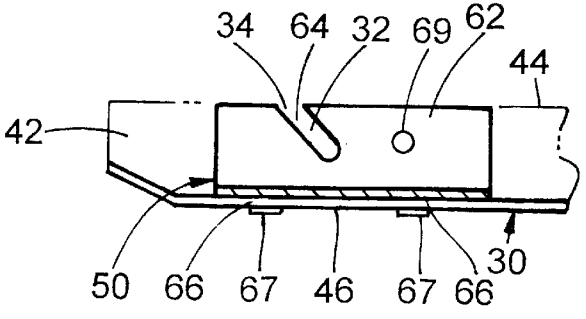
FIG. 6 is a view of a portion of the bracket assembly taken along lines 6—6 in FIG. 5.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the roof shingle placement tool 10 in accordance with the present invention and designated parts thereof. The terminology includes the words specifically mentioned above, derivatives thereof and words of similar import.

Referring to the drawings, wherein like numerals indicate like elements throughout, there is shown in FIGS. 1 through 8, a first embodiment of a roof shingle placement tool 10 in accordance with the present invention. As shown in FIG. 1, the roof shingle placement tool 10 includes a support member 12 which is adapted to be disposed generally horizontally on a roof 14 to be shingled. The support member 12 is used to provide a horizontal support to assist in properly aligning each shingle 16 in a course of shingles 16 being installed on the roof 14. The support member 12 provides a continuous support and sliding surface for the bottom edge of the shingles 16 to ensure that the course of shingles is uniformly aligned.

Figure 5:
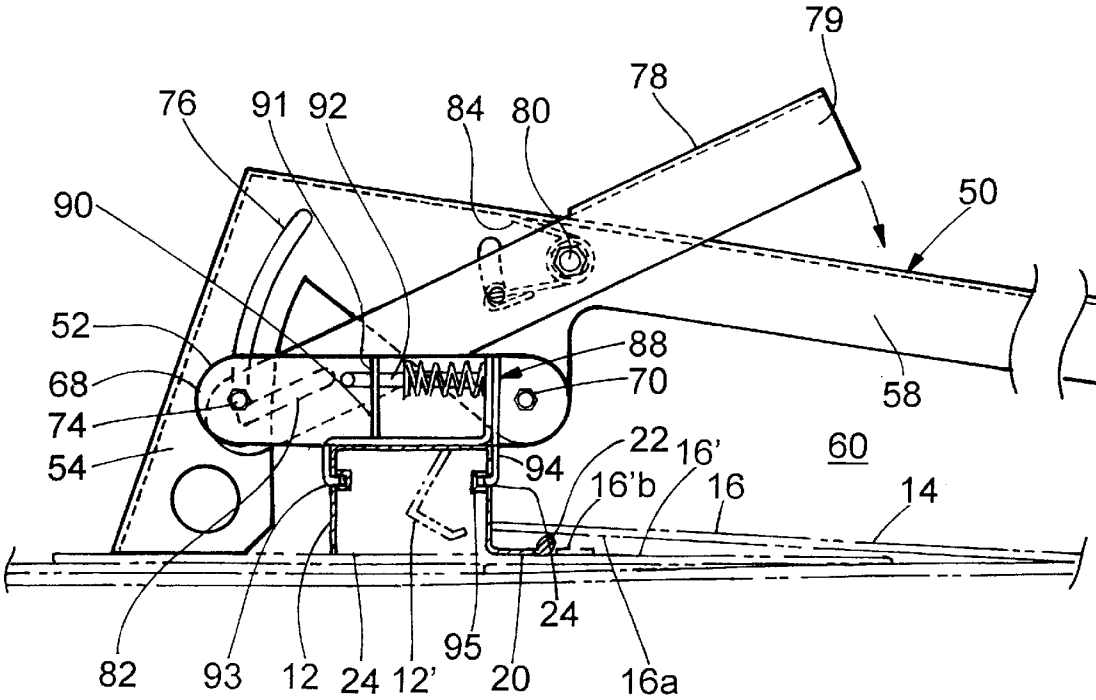
FIG. 5 is a side elevational view of a bracket assembly for the roof shingle placement tool of FIG. 1 taken along lines 5—5 in FIG. 1.
Figure 8:
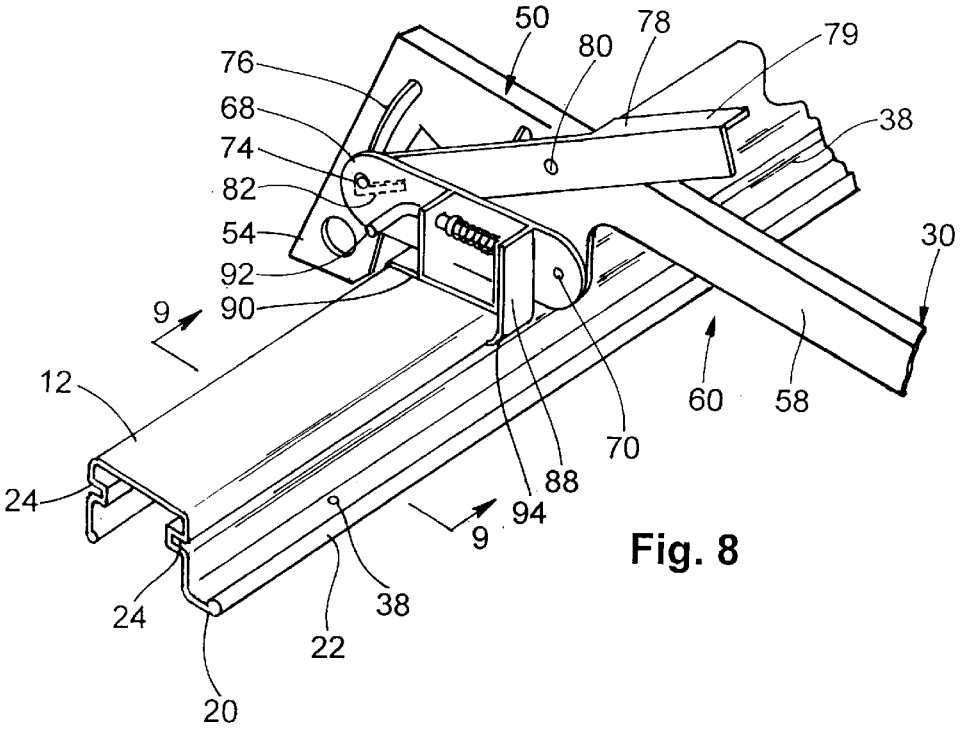
FIG. 8 is a perspective view of the bracket assembly of FIG. 5 showing the attachment to a support member.
Figure 9:
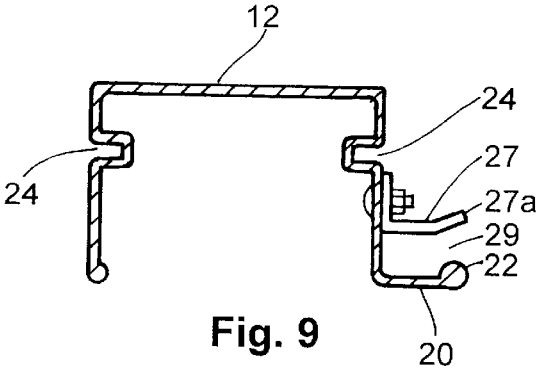
FIG. 9 is a cross-sectional view of the support member shown in FIG. 8.

As shown in detail in FIGS. 5, 8 and 9, the support member 12 includes a shaped portion 20, preferably in the form of a flange, which prevents the loss of shingles 16 beneath the support member 12 on an undulating surface. This is especially important for thin asphalt shingles 16 which can easily flex and deflect to the contour of the roof 14, possibly allowing the shingles 16 to slide under the support member 12. Preferably, the flange 20 is formed integrally with and extends from the support member 12 a distance which is sufficient to catch the bottom edges of the shingles 16, but not far enough to rest in the tar strip (typically found on asphalt shingles) of the previously installed course.

As shown in FIG. 9, preferably the flange has a raised portion 22 which, as shown in FIG. 5, elevates a lower surface 16*a* of the shingle 16 being supported to prevent adhesion to a sealing surface or tar strip 16'*b* on a shingle 16' from a previously installed course of shingles 16', or depending upon the type of shingle, prevents adhesion of a tar or sealing strip on the lower surface 16*a* of the shingle being installed to the previously installed course of shingles. It will be recognized by those skilled in the art from the present disclosure that the shaped portion 20 may have any suitable shape which is adapted to be located against a surface of the roof 14 and beneath the bottom edges of the shingles 16 and provides sufficient elevation to preclude adhesion of the shingle 16 to the tar strip 16'*b* on the previously installed course in order to allow shingles 16 to be slid along the support member 12 during the installation process, and is not limited to the preferred flange 20.

Referring to FIGS. 8 and 9, preferably the support member 12 is formed as an aluminum extrusion and includes grooves 24 running lengthwise which provide for easy clamping and locating of the support member 12, as explained in detail below. It will be recognized by those skilled in the art from the present disclosure that the support member 12 could be made of any other suitable material, such as wood, plastic or any other suitable metal which provides the desired structural integrity for supporting the shingles 16 as they are installed on the roof 14, and may be formed by other methods, such as break forming sheet metal. It will be similarly recognized that the cross-sectional configuration may be varied to any suitable form having sufficient stiffness to provide a straight support for the shingles 16.

Figure 10:
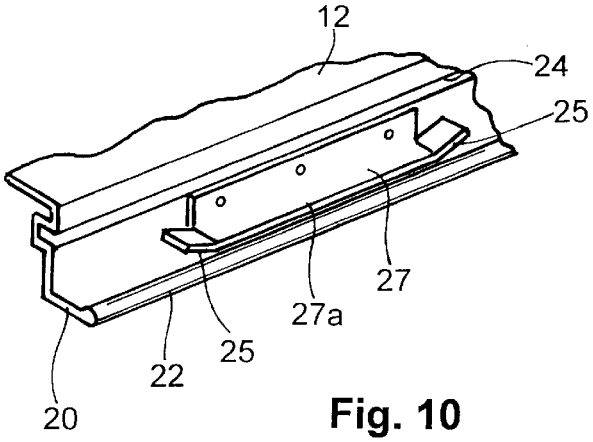
FIG. 10 is a perspective view showing an optional channel forming angle on the support member shown in FIG. 9.

As shown in FIG. 9, the support member 12 may include an optional upper angle 27 which is connected to the support member 12 using conventional fasteners. The upper angle 27 includes a flange 27*a* which is generally parallel to and spaced from the flange 20, creating a channel 29 in which the bottom edges of the shingles 16 are received. The channel 29 captures the bottom edges of the shingles 16 allowing the shingles 16 to be slid along the support member 12 without buckling of the shingles 16 as they are being positioned. The upper angle 27 and channel 29 need not be continuous along the entire length of the support member 12. As shown in FIG. 10, the ends of the upper angle 27 would include lead-in ramp surfaces 25 if the upper angle 27 is not continuous. It will be recognized by those skilled in the art from the present disclosure that the channel 29 could be formed integrally with the support member 12 extrusion, if desired.

Referring now to FIGS. 1–8, an indexing member 30 is connected to the support member 12. As shown in FIG. 1, preferably two indexing members 30 are connected to the support member 12 to provide parallel support on either side of the support member 12 to maintain the support member 12 generally horizontal such that the courses of shingles 16 are horizontally supported along the support member 12. Each indexing member 30 includes rail 42 having a plurality of equally spaced stops 32. As shown in detail in FIGS. 2 and 3, preferably the stops 32 comprise a row of equally spaced notches 34. The indexing member 30 is adapted to be indexed upwardly along the roof with succeeding stops 32 engaging a fixed reference point 40, or in the case where two indexing members are used, the succeeding stops 32 on each indexing member 30 engaging respective fixed reference points 40 on the roof 14, as shown in FIG. 1, such that a uniform exposure distance is provided by the support member 12 for succeeding courses of shingles 16. Preferably, each fixed reference point 40 comprises a single nail which is partially driven into the substrate of the roof 14 at a rafter location. The head of the nail is spaced from the surface of the roof 14 so that it can be easily engaged by the notches 34 on the rail 42, and can be easily removed by a claw hammer or other means when the roof 14 has been shingled up to the point where the nail is located. As shown in FIG. 3, the notches 34 are oriented to allow upward movement of the rail 42 to disengage the engaged notch 34 from the nail.

The notched rail 42, which is shown in detail in FIGS. 2–4, is preferably L-shaped in cross section and includes a plurality of equally spaced notches 34 along the first leg 44. The notches 34 are oriented at an angle that is directed generally downwardly when the rail 42 is in use such that the notches 34 create a plurality of hooks which can engage the fixed reference point 40. Preferably, a second plurality of notches 34' are located along the second leg 46 which are spaced at a different uniform distance in order to provide the possibility of two different shingle exposures using the same notched rail 42, depending upon the orientation of the rail 42. For example, the notches 34 along the first leg 44 may be set 5.0 inches apart and the notches 34' along the second leg 46 may be set 5.625 inches apart to provide two different uniform exposure distances. It will be recognized by those skilled in the art from the present disclosure that other distances may be used, if desired, and that the shape of the notched rail 42 may be altered to any other desired shape, such as a box section or any other desired cross section so that one or more rows of stops 32 (preferably in the form of notches 34) may be located along the rail 42. The rail 42 can then be connected to the support member 12 such that one of the plurality of notches 34 is adapted to be attached to the fixed reference point 40 on the roof.

As shown in detail in FIG. 2, preferably, the rail 42 of the indexing member 30 includes a ramped surface 48 on a forward end in an indexing direction to prevent tearing of a roof substrate during indexing. Preferably, a ramped surface 48' is provided on the second leg 46 as shown in FIG. 3 such that when the rail 42 is reversed to utilize the row of notches 34' with a different exposure spacing, the indexing member does not tear roof substrate during indexing.

Referring to FIGS. 1, 2, and 5–8, preferably the indexing member 30 further comprises a bracket assembly 50. As shown in detail in FIG. 5, preferably the bracket assembly 50 includes a first portion 54 and a second portion 56 which is connected to the rail 42. The bracket assembly 50 also includes a middle, bridge portion 58 which is adapted to provide a clearance space 60 between the first portion 54 and the second portion 56 to allow the placement of shingles 16 under the bracket assembly 50 as shown in FIGS. 1 and 5. Preferably, the second portion 56 of the bracket assembly 50 has a flange 62 with a notch 64 that aligns with the bottom most notch 34 in the rail 42 when the bracket assembly 50 is attached to the rail 42.

Figure 7:
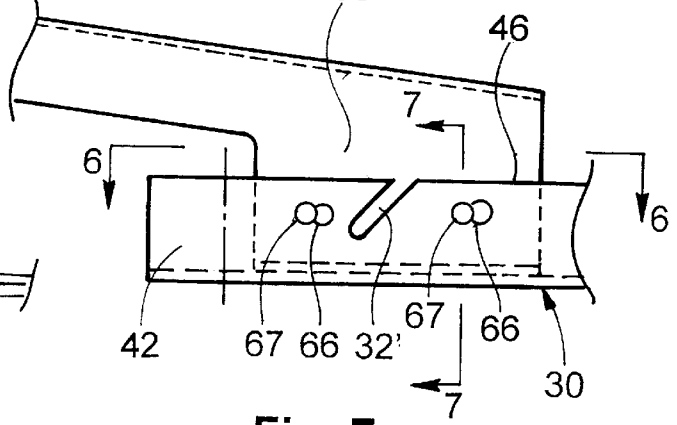
FIG. 7 is a cross-sectional view taken along lines 7—7 in FIG. 6.
Figure 7:
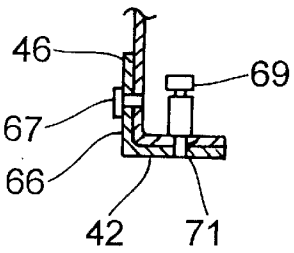

Preferably, the bracket assembly 50 is removably attached to the rail 42 using T-shaped fasteners 67 on the bracket assembly 50 engaging in key-hole shaped slots 66 on the rail 42, as shown in detail in FIGS. 5–7. A spring loaded button 69 located on the flange 62 engages a corresponding opening 71 in the first leg 44 of the rail 42. This provides ease of assembly of the rail 42 to the bracket assembly 50 without any loose parts. However, it will be recognized by those skilled in the art from the present disclosure that other types of attachments could be used between the bracket assembly 50 and the rail 42, such as threaded fasteners, or that the bracket assembly 50 can be formed integrally with the rail 42, if desired.

Still with reference to FIG. 5, the bracket assembly 50 includes a movable member 52 which is connected to the support member 12 such that the support member 12 can be disengaged from the bottom edges of a course of shingles 16. Preferably, the movable member 52 comprises a pivotable arm 68 which is pivotably mounted on the bracket assembly 50 via a pivotable connection 70. The pivotable connection 70 can be formed by a threaded fastener or any other suitable connection between the pivotable arm 68 and the bracket assembly 50. The pivotable arm 68 is connected to the support member 12 such that the support member 12 can be pivoted by the arm 68 from a first, shingle supporting position, as shown in FIG. 5 to a second position, out from under the bottoms of the shingles 16 in an installed course, as shown in phantom lines and designated 12' in FIG. 5.

A pin 74 is connected on an opposite end of the pivotable arm 68 from the pivotable connection 70. The pin 74 rides in arcuate slot 76 in the bracket assembly 50. An actuator lever 78 which includes a gripping portion 79 is also pivotably mounted to the bracket assembly 50 about a pivot point 80. A generally L-shaped slot 82 is formed in the actuator lever 78, which is aligned with the pin 74 in the pivotable arm 68. In the first, shingle supporting position, the pin 74 rests at the bottom of the arcuate slot 76 and in the short offset portion of the L-shaped slot 82 in the actuator lever 78. As the gripping portion 79 of the actuator lever 78 is pressed downwardly, the pivotable arm 68 initially remains in the position shown, until the bottom wall of the L-shaped slot 82 contacts the pin 74. As the actuator lever 78 is pushed further downwardly, the pin 74 rides along the bottom wall of the L-shaped slot 82 in the actuator lever 78 causing the pivotable arm 68 to rotate in a clockwise direction, with the pin 74 being guided in the arcuate slot 76 in the bracket assembly 50.

The actuator lever 78 is biased to a closed position via a spring 84 which acts on the actuator lever 78 such that the actuator lever 78 is biased to the first, shingle supporting position. Additionally, based on the initial position of the pin 74 in the offset portion of the L-shaped slot 82, the actuator lever 78 acts as a locking element which locks the pivotable arm 68 in the down position, so that even if a load is applied on the support member 12 when it is in the shingle supporting position, the pivotable arm 68 will not rotate until the actuator lever 78 is pressed. This prevents the support member 12 from moving relative to the bracket assembly 50 until the actuator lever 78 is pressed, in order to maintain correct alignment of the support member 12 to the roof 14.

It will be recognized by those skilled in the art from the present disclosure that other suitable means for moving the support member 12 such that it is disengaged from the bottom edges of the installed course of shingles 16 may be utilized, if desired. For example, a mechanism for linearly displacing the support member 12 downwardly out of engagement with the bottom edges of the shingles 16 could be used.

Preferably, the bracket assembly 50 is connected to the support member 12 with a slidable connection such that the support member 12 can be slid generally horizontally along the roof 14 in order to allow the support member 12 to be moved around obstacles such as dormers, chimneys, etc. In the first preferred embodiment of the roof shingle placement tool 10, the slidable connection comprises a spring loaded clamp 88, which is shown in detail in FIGS. 5 and 8. The spring loaded clamp 88 grips the grooves 24 located on each side of the support member 12. The clamp 88 includes a first portion 90 having a U-shaped bracket 91, which supports a spring loaded pin 92, and a first gripping hook 93, which can be engaged in a groove 24 on one side of the support member 12. The spring loaded pin 92 is connected to a second, movable clamping portion 94 having a second gripping hook 95, which faces the first gripping hook 93, such that when the spring loaded pin 92 is moved in a direction against the spring force, the second, movable clamping portion 94 moves away from the support member 12 such that the second hook 95 is disengaged from the groove 24, allowing the support member 12 to be slid relative to the clamp 88 or disengaged from the clamp 88. The first portion 90 of the clamp 88 is connected to the pivotable arm 68 on the bracket assembly 50.

It will be recognized by those skilled in the art from the present disclosure that other types of clamping mechanisms which allow for removable connection as well as sliding of the indexing member 30 relative to the support member 12 may be used, if desired, such as a screw actuated clamp.

As shown in FIG. 1, preferably two bracket assemblies 50 are provided, with each bracket assembly 50 being connected to a respective rail 42 of each indexing member 30. The support member 12 is slidably connected to both bracket assemblies 50 in order to provide even support for the support member 12 and allow the support member 12 to be indexed in a parallel manner upwardly along the surface of the roof 14 as succeeding courses of shingle 16 are installed.

Figure 15:
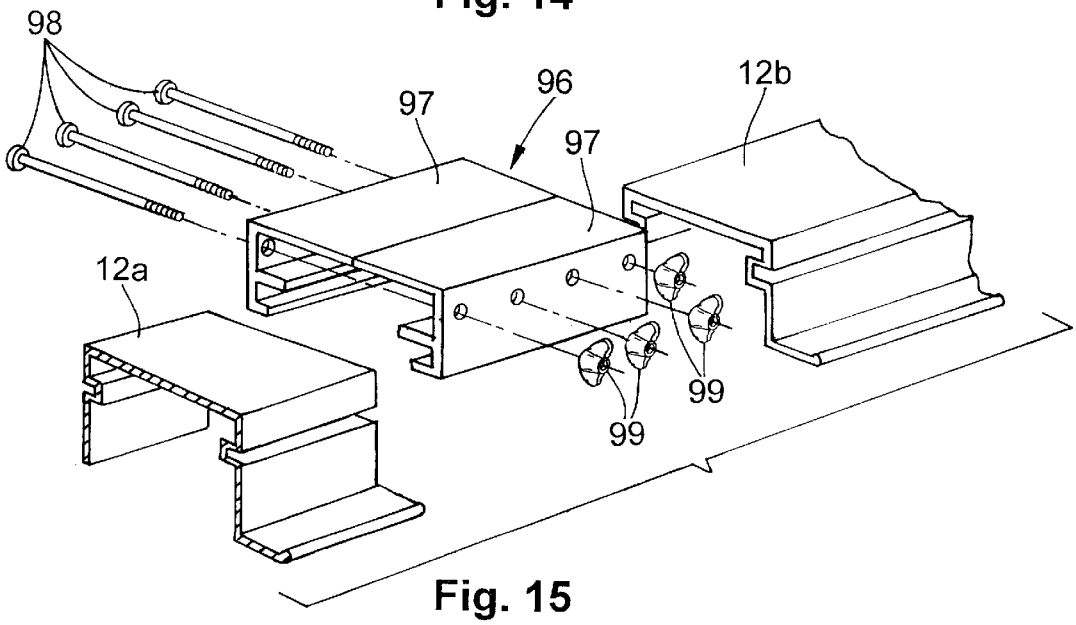
FIG. 15 is a perspective view of a clamp for connecting together two segments of the support member in accordance with the present invention.

Referring to FIG. 15, in the preferred embodiment the support member 12 is comprised of a plurality of interconnectable sections, such as 12*a*, 12*b*, which are connected using a support member splice 96. The support member splice 96 includes two clamp member 97 which are drawn together using threaded fasteners, such as carriage bolts 98 with wing nuts 99. The clamp members 97 are preferably extruded sections and include upper flanges which contact each other and force lower flanges to engage in the grooves 24 on the support member segments 12*a*, 12*b*. The wing nuts 99 and bolts 98 are used to apply clamping pressure such that the support member segments 12*a*, 12*b* are clamped together in an aligned position. The support member splice 96 provides positive clamping without interference with the function of the support member 12, and allows the support member 12 to be formed from shorter segments 12*a*, 12*b* which are easier to transport and set up as well as providing for ease of use in areas around obstacles on the roof 14. It will be recognized by those skilled in the art from the present disclosure that the support member splice 96 can have a variety of configurations, such as internal or external clamping members or may be in the form of a plug and socket connection, if desired.

In use, the roof shingle placement tool 10 is used to install shingles 16 on generally flat roof surfaces, with the placement tool 10 providing a generally horizontal support member 12 which can be indexed upwardly along the roof 14 to provide rapid and accurate alignment of shingles 16 with a uniform exposure. An indexing member 30, and preferably two indexing members 30, are connected to the support member 12, preferably using the bracket assemblies 50. A fixed member 40 is then attached to the roof 14 which is engageable by the indexing member 30. One fixed member 40 is required for each indexing member 30. In the preferred embodiment, the fixed member 40 comprises a nail which is driven partially into the roof substrate at a rafter location such that it can easily engaged and disengaged by the notches 34 on each rail 42 of the respective indexing members 30. Preferably, a starter course or first course of shingles is set by hand along the bottom edge of the roof 14 using a chalk line or another reference to keep the shingles 16 straight. The desired exposure is then determined. The support member 12 is assembled to the desired length using the interconnectable segments 12*a*, 12*b* and the edge clamp 96, as shown in FIG. 15, in order to clamp the segments 12*a*, 12*b* together. The support member 12 is then positioned relative to the installed starter course of shingle 16. This can be done using a sight hole 38 (shown in FIG. 8) on the support member 12. Alternatively, the support member 12 can be positioned by measuring up from the bottom edge of an installed course of shingles 16; measuring from the eave of the roof; measuring from the bottom edge of an installed shingle 16 to the support member 12 or another reference point on the tool; or sliding the flange 20 under the bottom edge of a shingle 16 on an installed course. The fixed reference point 40, such as a nail, is then driven into the roof substrate at a rafter location. Preferably, nails which are used as the fixed reference point 40 are driven in at two positions, with one nail being driven in at the upper end of each indexing member 30 aligned with the topmost notch 34 of the respective rail 42.

A course of shingles 16 is then set on the support member 12, or in the case where the support member 12 is indexed by inserting the flange 20 under the bottom edge of a previously installed course, the support member 12 is indexed upwardly using the rails 42 before setting a course of shingles 16. The shingles 16 are fastened in position on the roof 14 using a pneumatic nailer (not shown) or by hand. This can be accomplished by a single installer setting and nailing the shingles in position. However, the roof 14 can be shingled more quickly using two installers, with one installer primarily setting the first shingle 16 to the vertical reference lines and acting as the primary nailer and the other installer sliding shingles 16 along the support member 12 to the primary nailer. The primary nailer works his way across the roof aligning the slid shingles 16 in position and nailing them in place. Preferably, the second installer nails the last few shingles 16 along the course of shingles 16 at his end of the roof 14 to allow the primary installer to return to the opposite end of the roof 14 such that the roof shingle placement tool 10 can be indexed upwardly.

The roof shingle placement tool 10 is indexed upwardly along the roof 14 by disengaging a first index stop 32, which is preferably a notch 34 on the rail 42, from the fixed member 40. This is accomplished by pressing the actuator lever 78 downwardly toward the bracket assembly 50 such that the pivotable arm 68 rotates the support member 12 to the position shown as 12' in FIG. 5 such that the bottom edges of the installed course of shingles 16 are disengaged from the support member 12. The actuator lever 78 can be actuated from above or below the roof shingle placement tool 10. Generally, both installers have to press down on the actuator levers 78 at each bracket assembly 50 in order to disengage the support member 12 from the entire course of installed shingles 16. A single installer would have to inhibit the lock on one bracket assembly 50 so that the support member 12 could be disengaged using a single actuator lever 78. The entire roof shingle placement tool 10 is then slid upwardly along the roof 14 such that the fixed reference point 40 disengages from the stops 32, which are preferably notches 34 on the rails 42. The next lower stop on the rail 42 of each indexing member 30 is then engaged on the respective fixed reference point 40, which preferably requires only that the next lower notch 34 on the rail 42 engage the associated nail in the roof 14. The actuator levers 78 on each bracket assembly 50 are then released and the next course of shingles 16 is installed in a similar manner as outlined above. This process continues until the fixed reference point 40, which is preferably a nail, reaches the lowest notch 34. At this time, a new fixed reference point 40, in the form of a nail, is installed in the upper-most notch 34 in the rail 42 for each indexing member 30 and the nail in the lower-most notch 34 is then removed and the process is continued until the installers get to the ridge of the roof 14.

The same technique can be used for shingling a wall or other surface.

In order to bypass a small obstacle on the roof 14, such as a soil pipe, the entire roof shingle placement tool 10 can be lifted over the soil pipe once the shingling has advanced to the point of the soil pipe. This is due to the fact that the support member 12 and indexing members 30 are made of light weight materials, such as aluminum and are easily maneuvered on the roof 14. For large obstacles, such as dormers or chimneys, the support member 12 is adjusted sideways by either disconnecting segments 12*a*, 12*b* (FIG. 15) and/or releasing the spring loaded clamp(s) 88 on each bracket assembly 50 such that the support member 12 can be slid horizontally along the roof 14 to clear the obstacle. The indexing member 30 and bracket 50 which are on the side of the obstacle which is not being shingled are moved to the near side of the obstacle and a new fixed reference point 40 is established while the support member 12 remains properly aligned. Shingling then continues up the roof 14 on one side of the obstacle. When the shingling has continued past the obstacle, the support member 12 is align from the installed shingles on the opposite side of the obstacle, and shingling is continued up the roof. Shingling can be carried out on both sides of an obstacle with proper alignment and uniform exposure such that the shingles 16 are properly aligned above the obstacle.

In narrower areas, the rail 42 of the indexing member 30 can be used as a guide for installing a row of fixed members 40 in the roof 14, using the stops 32 of the indexing member 30 as a guide. In the preferred embodiment, this involves aligning the support member 12 and a notched rail 42 on the roof 14, as noted above, and installing a row of nails in the notches 34 using the notched rail 42 of the indexing member 30 as a guide. The indexing member 30 is then removed, and the rail 42 is disconnected from the bracket assembly 50. The support assembly comprising the bracket assembly 50 with a short support member segment 12a is then used to install shingles 16 going up the roof 14 using the notch 64 on flange 62 of the bracket assembly 50 to index the support assembly upwardly along the roof 14 by disengaging the stop 32 (in the form of the notch 64) from the first selected fixed member 40 (the lowermost nail), moving the support assembly upwardly along the roof 14, and engaging the notch 64 on the next higher fixed member 40 (the next succeeding nail) in the row of fixed member 40.

In order to index the support assembly upward, the actuator lever 78 must be depressed to disengage the shaped portion 20 from the bottom edges of the shingles 16 in the installed course.

For installing slate, tile, composition or wood shingles, the support member 12 can be reversed such that the back side of the support member 12 is used as a rest for supporting the shingles 16. The flange 20 is not required or desired due to the stiffness and thickness of this type of shingle and additionally, the pivoting movement of the support member 12 to disengage the flange 20 from the bottom edges of the shingles would likely loosen the fasteners due to the stiffness of the shingles. For slate or tile type shingles, a L-shaped piece of thin metal can be used to prevent the slates or tiles from sliding under the support member 12 if the roof is not flat to the point that the gap between the support member 12 and the roof 14 exceeds the thickness of the shingle material.

Referring now to FIGS. 11–13, a second embodiment of a roof shingle placement tool 110 is shown. The second embodiment of the roof shingle placement tool 110 is similar to the first embodiment 10, and like elements have been identified with the same reference numerals with the prefix "1". For example, the support member 112 in accordance with the second preferred embodiment of the roof shingle placement tool 110 is similar to the support member 12 in accordance with the first preferred embodiment 10. Accordingly, a complete description of the similar items has been omitted for the sake of convenience only, and the differences between the first embodiment and the second embodiment 110 of the roof shingle placement tool are described in detail below.

As shown in FIG. 11, in the second embodiment of the roof shingle placement tool 110, a pivotable connection 131 is provided between the indexing member 130 and the support member 112. Preferably, two indexing member 130 are provided and a pivotable connection 131 is provided between each indexing member 130 and the support member 112. The pivotable connection 131 includes a clamp 133, shown in detail in FIGS. 12 and 13. The clamp 133 includes two clamp plates 135*a*, 135*b*, which are adapted to engage the grooves 124 on either side of the support member 112. The clamp plates 135*a*, 135*b* are tightened in position on the support 112 using threaded fasteners, such as carriage bolts 136 and wing nuts 137.

A pivot post 139 is located on one of the clamp plates 135a and provides a pivotal connection for an extension 141 from a notched rail 142. An adjustment plate 143, best illustrated in FIG. 13, which includes an elongated slot 145 and an opening 147 through which the extension 141 passes, is slidably mounted on the second clamp plate 135*b*. By sliding the adjustment plate 143 in either direction along the support member 112 prior to tightening the wing nuts 137 on carriage bolts 136, the angle of the extension 141 and the notched rail 142 of the indexing member 130 can be adjusted to an angle $\alpha$ in order to provide a desired exposure. The exposure would be equal to the product of the spacing between the notches 134 in the rail 142 and sin $\alpha$. This provides for infinite adjustability such that a uniform shingle exposure can be achieved across a desired length by adjusting and then locking the indexing member 130 to the desired angle to achieve the proper exposure.

It will be recognized by those skilled in the art from the present disclosure that other types of clamps 133 may be used to provide the adjustable clamping feature for clamping the indexing member 130 to the support member at a desired angle $\alpha$ to achieve a desired exposure. It will be similarly recognized that a group of interchangeable rails 142 can be provided with a different fixed spacing between the notches 134, which would provide a maximum exposure in the position where $\alpha$ equals 90 degrees, but which can be adjusted to provide a shorter exposure by adjusting the angle $\alpha$ and clamping the notched rail 142 at the desired angle $\alpha$ to achieve a desired lesser uniform exposure between courses of shingles 116.

In use, the second embodiment of the roof shingle placement tool 110 is used in a similar manner to the roof shingle placement tool 10. However, as shown in FIG. 12 the flange 120 on the support member 112 may not be used, depending upon the type of roofing material being installed, and faces down the roof slope. The support member 112 cannot rotated away from the bottom edge of the installed course of shingles 116 and the entire assembly 110 is lifted slightly upwardly prior to disengaging the notches or slots 134 on the notched rails 142 from the fixed reference points in the form of nails 140 in order to index the roof shingle placement tool 110 upwardly along the roof. The next lower notch or slot 134 on the rail 142 is then engaged with the fixed reference point 140 in order to set the next course of shingles 116 at the desired exposure.

Figure 14:
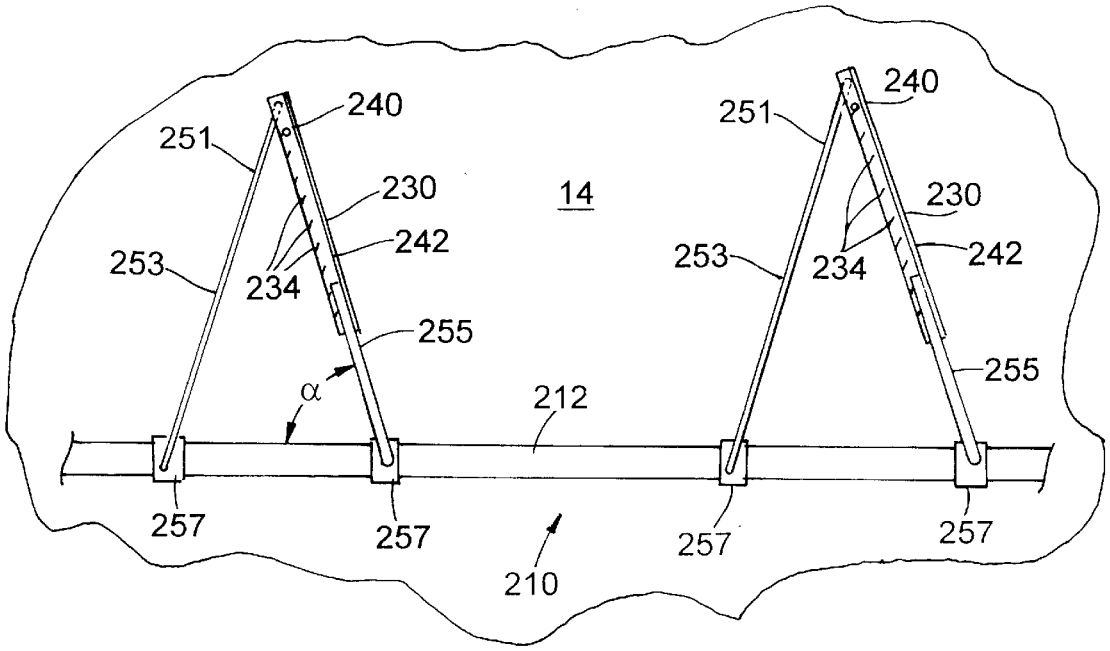
FIG. 14 is a plan view of a third embodiment of a roof shingle placement tool in accordance with the present invention.

Referring now to FIG. 14, a third embodiment of a roof shingle placement tool 210 is shown. The third embodiment of the roof shingle replacement tool 210 is similar to the second embodiment 110, and like elements have been identified with similar reference numerals with the prefix "2". For example, the support member 212 of the third preferred embodiment of the roof shingle placement tool 210 is similar to the support member 112 of the second embodiment of the roof shingle placement tool 110. Accordingly, a description of these similar features has been omitted for convenience only and is not considered limiting. The differences between the third preferred embodiment of the roof shingle placement tool 210 and the second preferred embodiment of the roof shingle placement tool 110 are described in detail below.

As shown in FIG. 14, in the third preferred embodiment of the roof shingle placement tool 210, the support member 212 is supported preferably in two positions by indexing members 230. The indexing members 230 are preferably in the form of triangular supports 251.

Each triangular support 251 includes two pivotably connected links 253, 255. The first link 253 is a support link and the second link 255 includes the notched rail 242 for indexing the support member 212 upwardly. The bottom end of each link 253, 255 is pivotably and slidably connected to the support member 212 using a clamp member 257. The angle $\alpha$ of the second link 255 and hence the notched rail 242 is set at a desired angle to achieve a desired uniform exposure, based on a function of sin $\alpha$ times the distance between the slots or notches 234 on each rail 242, similar to the second embodiment 110.

The sliding clamps 257 may be similar to the clamps 133 in accordance with the second preferred embodiment of the invention. However, the clamps 257 may have any suitable arrangement for clamping the support member 212 and providing a pivotable connection to the respective first or second links 253, 255. The notches 234 on each rail 242 are successively engaged on a respective single fixed reference 240, which is preferably a nail driven through the roof substrate and into a roof rafter, in order to allow the support member 212 to be indexed upwardly along a roof or wall in order to allow succeeding courses of shingles (not shown) to be installed with a uniform exposure distance.

It will be recognized by those skilled in the art from the present disclosure that the bracket assembly 50 of the first embodiment 10 which rotates the support member 12 out from under the bottom edges of an installed course of shingles 16 could be pivotably connected to a support rail 42 to provide infinite adjustment for the shingle exposure, similar to the second and third embodiments 110, 210 of the invention. The pivotable connection would be located at the connection between the rail and the bracket assembly 50 so that both bracket assemblies would remain generally perpendicular to the courses of shingles being installed.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A roof shingle placement tool comprising:

a support member adapted to be disposed generally horizontally on a roof to be shingled;

an indexing member connected to the support member, the indexing member including a plurality of equally spaced stops, each said stop including a notch with an open end directed downwardly along the indexing member, the indexing member being adapted to be indexed upwardly along the roof with succeeding stops engaging a single fixed reference point on the roof which comprises a single fastener having a shank projecting from the roof which is engageable in each said stop by movement of the indexing member upwardly along the roof adjacent to the single fastener to a desired stop and downward movement of the indexing member with the notch engaging the shank of the single fastener such that a uniform exposure distance is provided by the support member for succeeding courses of shingles.

2. The roof shingle placement tool of claim 1 wherein the indexing member further comprises a bracket assembly, the bracket assembly includes a movable member which engages the support member such that the support member can be disengaged from a bottom edge of an installed course of shingles.

3. The roof shingle placement tool of claim 2 wherein the bracket assembly includes a locking element which locks the support member in a shingle supporting position to prevent the support member from moving relative to the bracket assembly until the locking element is released.

4. The roof shingle placement tool of claim 2 wherein the bracket assembly includes a first portion which is adapted to contact the roof and a second portion which is connected to the indexing member, the bracket assembly having a middle, bridge portion which is adapted to provide a space between the first portion and the second portion to allow the placement of shingles under the bracket assembly.

5. The roof shingle placement tool of claim 1 wherein the support member is connected to the indexing member by a bracket assembly, the bracket assembly includes a pivotable arm which is connected to the support member such that the support member is adapted to be pivoted by the arm from a first, shingle supporting position, to a second position, away from the surface of the roof.

6. The roof shingle placement tool of claim 5 wherein the bracket assembly is connected to the support member with a slidable connection such that the support member is adapted to be slidable generally horizontally along the roof.

7. The roof shingle placement tool of claim 6 wherein the slidable connection comprises a spring loaded clamp.

8. The roof shingle placement tool of claim 5 wherein there are two indexing members, each indexing member includes a bracket assembly, and both bracket assemblies are connected to the support member.

9. The roof shingle placement tool of claim 5 wherein the pivotable arm is actuated by a lever connected on the bracket assembly, the lever includes an actuating pin which rides in a slot defined in the pivotable arm such that pressing on the lever moves the pivotable arm to rotate the support member away from the surface of the roof.

10. The roof shingle placement tool of claim 9 wherein the slot defined in the pivotable arm includes a locking portion which is adapted to lock the pivotable arm in position to prevent rotation and loss of shingles when the support member is loaded.

11. The roof shingle placement tool of claim 5 wherein the bracket assembly includes a first portion and a second portion, the second portion is adapted to be connected to a notched rail, the bracket assembly having a middle, bridge portion which is adapted to provide a space between the first portion and the second portion to allow the placement of shingles under the bracket assembly.

12. The roof shingle placement tool of claim 1 wherein the support member includes a flange which is adapted to be located against a surface of the roof beneath bottom edges of the shingles being installed along the support member.

13. The roof shingle placement tool of claim 1 wherein the support member provides a continuous support surface.

14. The roof shingle placement tool of claim 1 wherein the support member includes a shaped portion which prevents loss of shingles beneath the support member on an undulating surface.

15. The roof shingle placement tool of claim 14 wherein the shaped portion elevates a lower surface of a shingle being supported to prevent adhesion to a sealing surface on one of a previously installed shingle and the shingle being supported.

16. The roof shingle placement tool of claim 1 wherein an anti-buckling member is attached to the support member to prevent buckling of shingles as they are being positioned along the support member.

17. The roof shingle placement tool of claim 1 wherein a first plurality of notches with a first exposure spacing are located on one portion of the indexing member and a second plurality of notches with a second exposure spacing are located on a second portion of the indexing member, the indexing member being connectable to the support member such that one of the first and second plurality of notches are adapted to be attached to the fixed reference point on the roof.

18. The roof shingle placement tool of claim 1 wherein a pivotable connection is provided between the indexing member and the support member, the pivotable connection includes a clamp for fixing the indexing member at a selected angle relative to the support member such that the uniform exposure distance provided by the indexing member is adjustable based on the selected angle.

19. The roof shingle placement tool of claim 1 wherein the indexing member includes a ramped surface on a forward end in an indexing direction to prevent tearing of a roof substrate during indexing.

20. The roof shingle placement tool of claim 1 wherein the support member comprises at least two interconnectable sections.

21. A method of locating shingles on a roof with a desired exposure between courses of shingles, comprising the steps of:

(a) providing a support member and an indexing member connected to the support member, the indexing member including a plurality of equally spaced stops;

(b) attaching a fixed member on the roof which is engageable by the indexing member by installing a nail in the roof;

(c) setting a course of shingles on the support member;

(d) fastening the shingles in position on the roof; and (e) indexing the support member upwardly along the roof by disengaging a first index stop on the indexing member from the fixed member, moving the indexing member upwardly along the roof, and engaging a next stop of the indexing member on the fixed member.

22. The method of claim 21 further comprising connecting two indexing members to the support member, and attaching a fixed member to the roof for each indexing member.

23. The method of claim 21 further comprising the steps of installing a first course of shingles along a bottom most edge of the roof, aligning the support member with the first course of shingles, and attaching the fixed member to the roof by aligning the fixed member with one of the stops on the indexing member such that the remaining courses of shingles can be installed by indexing the indexing member upwardly along the roof.

24. The method of claim 21, wherein the indexing member is connected to the support member by a bracket assembly, the bracket assembly includes a pivotable arm which is connected to the support member, and the support member includes a shaped portion adapted to support a bottom edge of the shingles in the course of shingles being installed, and prior to the step of indexing the support member upwardly along the roof, moving the support member with the pivotable arm to a position such that the shaped portion is disengaged from the bottom edges of the shingles in the installed course.

25. The method of claim 21 wherein the indexing member is pivotably connected to the support member such that the angle between the indexing member and the support member can be adjusted, the method further including the steps of: determining a desired exposure, and adjusting the angle of the indexing member relative to the support member to obtain the desired exposure.

26. A method of locating shingles on a roof with a desired exposure between courses of shingles, comprising the steps of:

(a) providing an indexing member having a plurality of equally spaced stops and a support assembly having at least one stop;

(b) installing a row of fixed members in the roof using the stops of the indexing member as a guide;

(c) removing the indexing member;

(d) placing the support assembly on the roof with the stop engaging a selected fixed member in the row of fixed members;

(e) installing at least a portion of a course of shingles using the support assembly; and (f) indexing the support assembly upwardly along the roof by disengaging the stop on the support assembly from the selected fixed member, moving the support assembly upwardly along the roof, and engaging the stop on a next fixed member in the row of fixed members.

27. The method of claim 26, wherein the support assembly comprises a support member and a bracket assembly, the bracket assembly having at least one stop, and being adapted to be connected to the support member.

28. The method of claim 27, wherein the bracket assembly includes a pivotable arm which is connected to the support member, and the support member includes a shaped portion adapted to support a bottom edge of the shingles in the course of shingles being installed, and prior to the step of indexing the support assembly upwardly along the roof, moving the support member on the pivotable arm to a position such that the shaped portion is disengaged from the bottom edges of the shingles in the installed course.

* * * * *